US008069791B1

(12) United States Patent
Kunstmann et al.

(10) Patent No.: US 8,069,791 B1
(45) Date of Patent: Dec. 6, 2011

(54) CURVILINEAR SABOT SYSTEM

(75) Inventors: John Kunstmann, King George, VA (US); Gregory Chicchirichi, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 135 days.

(21) Appl. No.: 12/799,012

(22) Filed: Mar. 31, 2010

(51) Int. Cl.
*F42B 14/00* (2006.01)

(52) U.S. Cl. ..... 102/520; 102/521; 102/522

(58) Field of Classification Search ..... 102/520, 102/521, 522
See application file for complete search history.

(56) References Cited

U.S. PATENT DOCUMENTS 4,029,018 A 6/1977 Bjornson
4,419,796 A 12/1983 Broden et al.
4,608,927 A 9/1986 Romer et al.
4,850,279 A 7/1989 Fuchs et al.
4,936,219 A 6/1990 Mudd
5,012,744 A 5/1991 Sowash
5,016,538 A 5/1991 Sowash
H941 H * 8/1991 Wyluda ..... 102/522
5,214,238 A * 5/1993 Young ..... 102/520
5,481,981 A 1/1996 Sippel et al.
6,073,560 A * 6/2000 Stone ..... 102/522
7,137,218 B1 * 11/2006 Adkins, Jr. ..... 42/51
7,549,376 B1 * 6/2009 Grossman et al. ..... 102/473

* cited by examiner

*Primary Examiner* — J. Woodrow Eldred
(74) *Attorney, Agent, or Firm* — Fredric J. Zimmerman

(57) ABSTRACT

A sabot system is defined by a tubular arrangement of curvilinear segments with the tubular arrangement being closed on a first end thereof and open on a second end thereof. The tubular arrangement defines a first outer diameter at its first end and a second and larger outer diameter at its second end. Each segment is made from an elastic material such that when the tubular arrangement is compressed radially at its second end, each of the segments stores a spring force.

9 Claims, 2 Drawing Sheets

CURVILINEAR SABOT SYSTEM

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to sabots, and more particularly to a sabot system using curvilinear sabot segments for efficient discard at projectile launch.

BACKGROUND OF THE INVENTION

A sabot supports a subcaliber projectile/round in a larger caliber launch barrel. After launch, a sabot should release or fall away from the projectile/round. Ideally, this situation occurs very quickly after the launch barrel is exited. Typically, sabot petals or segments are straight along their length and depend entirely on aerodynamic forces to bring about their separation from a projectile after exiting a launch barrel. Some sabot systems utilize retaining systems that must fail before aerodynamic forces can act on the petals/segments. Thus, current sabot systems designs have some inherent inefficiencies that can cause sabot petals/segments to remain with the projectile segments longer than necessary. These inefficiencies may cause unwanted drag and/or destabilizing forces on the projectile/round that ultimately affect its trajectory and/or range.

SUMMARY OF THE INVENTION

Accordingly, it is an object of the present invention to provide a sabot system that is discarded from a launched projectile/round in an efficient fashion.

Another object of the present invention is to provide a sabot system that is simple and reliable.

Other objects and advantages of the present invention will become more obvious hereinafter in the specification and drawings.

In accordance with the present invention, a sabot system is defined by a tubular arrangement of curvilinear segments adapted to receive a subcaliber projectile therein. The tubular arrangement is closed on a first end thereof and open on a second end thereof. The tubular arrangement defines a first outer diameter at its first end and a second outer diameter at its second end. The first outer diameter is less than the second outer diameter. Each segment is made from an elastic material such that when the tubular arrangement is compressed radially at its second end, each of the segments stores a spring force.

BRIEF DESCRIPTION OF THE DRAWINGS

Other objects, features and advantages of the present invention will become apparent upon reference to the following description of the exemplary embodiments and to the drawings, wherein corresponding reference characters indicate corresponding parts throughout the several views of the drawings and wherein.

DETAILED DESCRIPTION OF THE INVENTION

Figure 2:
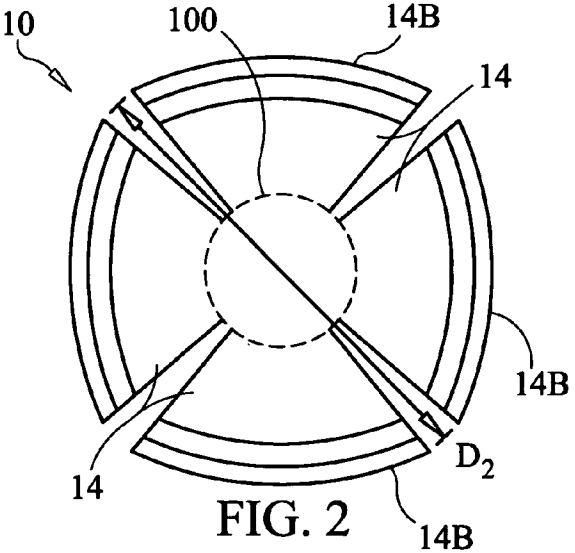
FIG. 2 is a head on view of the sabot system taken along line 2-2 in FIG. 1.
Figure 1:
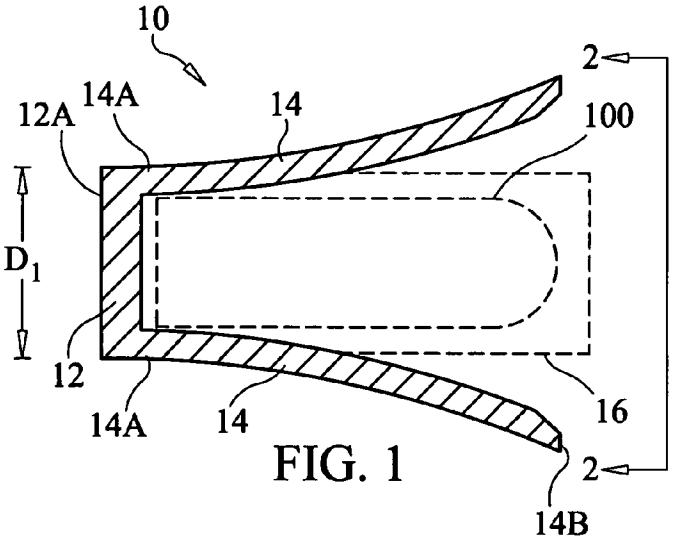
FIG. 1 is a side cross-sectional view of a sabot system prior to its placement in a launch barrel in accordance with an embodiment of the present invention.

Referring now to the drawings, simultaneous reference will be made to FIGS. 1 and 2 where a sabot system in accordance with the present invention is referenced generally by numeral 10. Sabot system 10 is illustrated as it would appear prior to its positioning in a launch barrel. As would be understood in the art, sabot system 10 is designed to hold or support a projectile 100 (illustrated by dashed lines to indicate that it is not part of the present invention) which is a subcaliber projectile or round in terms of the barrel (not shown) that it is to be launched from. Further, while projectile 100 is completely contained within sabot system 100, the present invention is not so limited as projectile 100 could partially protrude from sabot system 10.

Sabot system 10 includes multiple elements that can be fabricated as an assembly or as an integrated, one-piece structure without departing from the scope of the present invention. Accordingly, it is to be understood that the particular construction/fabrication details used to make sabot system 10 are not limitations of the present invention, and that words such as "coupled," "attached," etc., used herein apply equally as well to mechanically linked elements and integrated elements.

Sabot system 10 includes a base plate 12 (i.e., also referred to in the art as a "pusher plate") and a number of petals or segments 14 coupled to and extending away from plate 12 to form an open tube-like structure. Segments 14 extend along projectile 100 and are distributed about radial surfaces of projectile 100 as illustrated. In the illustrated embodiment, four segments 14 are shown. However, more or fewer segments could be used in the present invention without departing from the scope of thereof.

Base plate 12 is generally a circular plate of diameter "$D_1$" that will allow it to form a sliding fit with the internal diameter of a launch barrel. The outer face 12A of base plate 12 will receive launch impulse when sabot system 10 and projectile 100 are to be expelled from a launch barrel. Accordingly, base plate 12 will generally be solid as illustrated.

Each of segments 14 will generally be the same so that a description of one segment 14 will provide an understanding of the present invention. However, as will be appreciated by one of ordinary skill in the art, segments 14 need not be identical to accomplish the goals of efficient discard in accordance with the present invention.

Each segment 14 extends from its constrained end 14A (i.e., where coupled to base plate 12 such that ends 14A lie within the confines of diameter $D_1$) along all (or a portion) of projectile 100 to an unconstrained end 14B. Between ends 14A and 14B, segment 14 traverses a curvilinear path (e.g., a simple arc as shown) such that end 14B lies outside an imagi nary right circular cylinder (indicated by dashed line 16) formed by an axial extension of base plate 12. For example, ends 14B could reside on the perimeter of circle (as best seen in FIG. 2) having a diameter "$D_2$" that is larger than diameter $D_1$.

In addition to their curvilinear structure described above, each of segments 14 is made from a flexible and elastic material. That is and as will be explained further below, when segments 14 are compressed radially towards projectile 10, each of segments 14 develops and stores a spring force in opposition to the radial compression force. Suitable materials for segments 14 (and base plate 12) include a variety of plastics and metals, the choice of which is not a limitation of the present invention.

Figure 3:
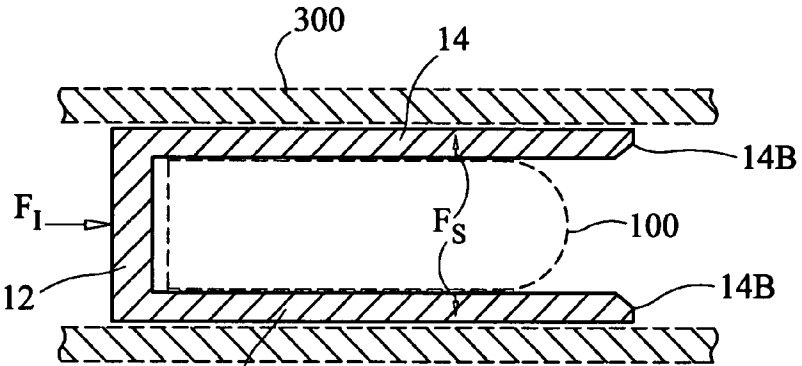
FIG. 3 is a cross-sectional view of the sabot system positioned in a launch barrel.
Figure 4:
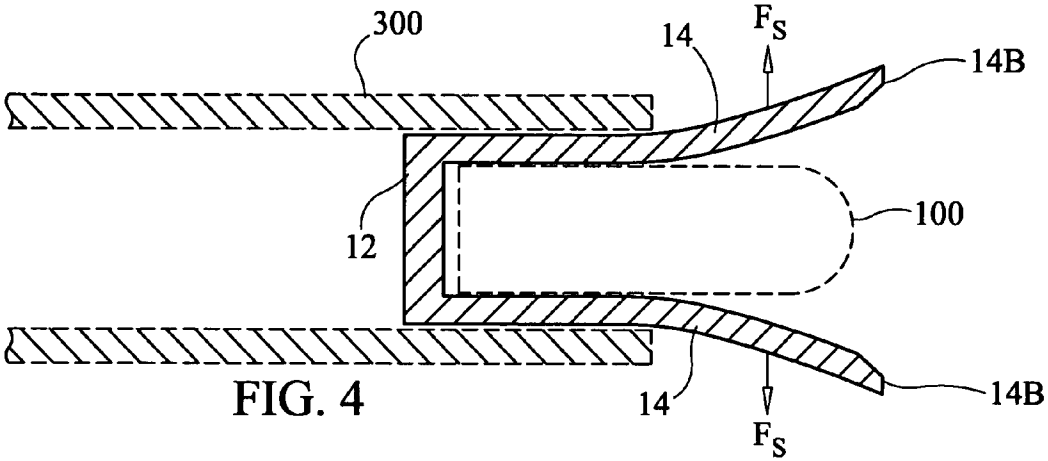
FIG. 4 is a cross-sectional view of the sabot system as it begins to exit the launch barrel.

In operation, sabot system 10 and projectile 100 are positioned in a barrel 300 of a launcher as illustrated in FIG. 3. The inner surface of barrel 300 causes ends 14B of segments 14 to be compressed radially against projectile 100 such that segments 14 develop and store a spring force $F_s$. During launch, base plate 12 receives an impulse force $F_I$ that propels sabot system 10 and projectile 100 down barrel 300. When ends 14B exit barrel 300 as illustrated in FIG. 4, spring force $F_s$ acts to initiate the spreading of segments 14 from projectile 100. That is, the discard operation of sabot system 10 is initiated before it fully exits barrel 300. This pre-spreading of segments 14 allows sabot system 10 to make more efficient use of aerodynamic forces since segments more readily catch air as sabot system 10 exits barrel 300. Furthermore, the initiation of segment spreading does not require the failure of a retaining system for its operation. Therefore, sabot system 10 achieves its discard operation in an efficient and reliable fashion.

Figure 6:
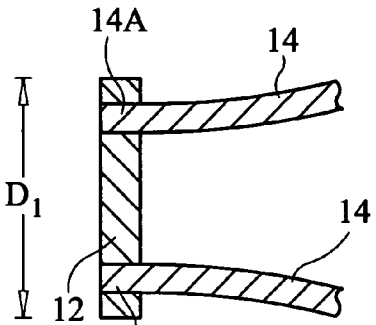
FIG. 6 is a cross-sectional view of an aft end of a sabot system in accordance with yet another embodiment of the present invention.
Figure 5:
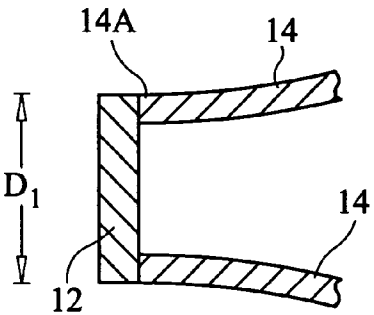
FIG. 5 is a cross-sectional view of an aft end of a sabot system in accordance with another embodiment of the present invention.

Although the invention has been described relative to a specific embodiment thereof, there are numerous variations and modifications that will be readily apparent to those skilled in the art in light of the above teachings. For example, unconstrained ends 14B can be tapered as shown to direct air flow into the tube-like region defined by segments 14 thereby hastening the spreading of segments 14 as they exit barrel 300. In addition and as mentioned above, ends 14A can be coupled to base plate 12 in a variety of ways. Two other exemplary embodiments are illustrated in FIGS. 5 and 6. In FIG. 5, ends 14A are coupled to the outside edge face of base plate 12 such that diameter $D_1$ is defined by the outside edges of base plate 12. In FIG. 6, ends 14A are fitted in base plate 12 with the outer edges of base plate 12 forming an annular ring that forms a sliding fit with a launch barrel. It is therefore to be understood that, within the scope of the appended claims, the invention may be practiced other than as specifically described.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed as new and desired to be secured by Letters Patent of the United States is:

1. A sabot system, comprising:

a plurality of sabot segments adapted to be distributed about a radial surface of a projectile that has a nose and an aft end, said plurality of sabot segments are constrained at first ends thereof in proximity to the aft end of the projectile with said first ends so-constrained defining a first outer dimension that exceeds a caliber of the projectile, each of said plurality of sabot segments remaining unconstrained at second ends thereof, each of said plurality of sabot segments being made of a flexible material, and each of said plurality of sabot segments defining a curvilinear path along the length thereof such that said second ends so-unconstrained define a second outer dimension that exceeds that of said first outer dimension.

2. The sabot system as in claim 1, wherein each of said first outer dimension and said second outer dimension comprises a diameter of a circle.

3. The sabot system as in claim 1, further comprising a plate being coupled to said first ends of said segment adjacent to the aft end of the projectile.

4. The sabot system as in claim 1, wherein each of said plurality of sabot segments is made from an elastic material.

5. The sabot system as in claim 1, wherein each of said second ends is tapered.

6. A sabot system, comprising:

a tubular arrangement of curvilinear segments being adapted to receive a subcaliber projectile therein, said tubular arrangement being closed on a first end thereof and open on a second end thereof, said tubular arrangement defining a first outer diameter at said first end and defining a second outer diameter at said second end, wherein said first outer diameter is less than said second outer diameter, and each of said curvilinear segments made from an elastic material wherein, when said tubular arrangement is compressed radially at said second end, each of said curvilinear segments stores a spring force.

7. The sabot system as in claim 6, wherein each of said curvilinear segments is tapered at said second end of said tubular arrangement.

8. A sabot system for a subcaliber projectile, comprising:

a base having an outer diameter adapted to slidingly fit in a weapon's barrel; and a plurality of longitudinal and curvilinear segments, each of said plurality of longitudinal and curvilinear segments coupled on a first end thereof to said base wherein each said first end is maintained within the confines of said outer diameter of said base, each of said plurality of longitudinal and curvilinear segments extending to a second end thereof that is unencumbered and located outside an imaginary right circular cylinder formed by an extension of said base, and each of said plurality of longitudinal and curvilinear segments being made from an elastic material.

9. The sabot system as in claim 8, wherein each of said plurality of longitudinal and curvilinear segments is tapered at said second end thereof.

* * * * *